US011473811B2

(12) United States Patent
Jin

(10) Patent No.: US 11,473,811 B2
(45) Date of Patent: Oct. 18, 2022

(54) WIND BAFFLE FOR PREVENTING REVERSE FAN TORQUE

(71) Applicants: TRANE AIR CONDITIONING SYSTEMS (CHINA) CO., LTD., Taicang (CN); TRANE INTERNATIONAL INC., Davidson, NC (US)

(72) Inventor: Zi Xia Jin, Shanghai (CN)

(73) Assignees: TRANE INTERNATIONAL INC., Davidson, NC (US); TRANE AIR CONDITIONING SYSTEMS (CHINA) CO., LTD., Taicang (CN)

( * ) Notice: Subject to any disclaimer, the term of this patent is extended or adjusted under 35 U.S.C. 154(b) by 0 days.

(21) Appl. No.: 16/936,986

(22) Filed: Jul. 23, 2020

(65) Prior Publication Data

US 2021/0199336 A1 Jul. 1, 2021

(30) Foreign Application Priority Data

Dec. 31, 2019 (CN) ..... 201922498064.X

(51) Int. Cl.
*F24F 13/08* (2006.01)
*F04D 29/40* (2006.01)

(52) U.S. Cl.
CPC ..... *F24F 13/082* (2013.01); *F04D 29/403* (2013.01)

(58) Field of Classification Search
CPC .... F24F 13/082; F24F 13/062; F24F 2221/40; F24F 2221/52; F24F 1/38; F24F 1/48; F24F 1/56; F24F 2013/0616; F24F 7/065; F24F 7/007; F24F 7/06; F04D 29/403; F04D 29/703
USPC ..... 451/311
See application file for complete search history.

(56) References Cited

U.S. PATENT DOCUMENTS 7,334,988 B2 * 2/2008 Horng ..... F04D 29/544 415/211.2
2020/0072492 A1 * 3/2020 Uriarte ..... F24F 13/0209

FOREIGN PATENT DOCUMENTS

| | | | | |
|---|---|---|---|---|
| CN | 207865567 U | 9/2018 | | |
| CN | 208804791 U | 4/2019 | | |
| DE | 3644590 A1 * | 7/1988 | ..... | F24F 13/072 |
| EP | 2716984 B1 | 3/2016 | | |
| JP | 2008116123 A | 5/2008 | | |

(Continued)

OTHER PUBLICATIONS

Jan. 29, 2019, About Wind Baffles, Wind Baffles Direct (Year: 2019).*

*Primary Examiner* — Edelmira Bosques
*Assistant Examiner* — Michael James Giordano
(74) *Attorney, Agent, or Firm* — Hamre, Schumann, Mueller & Larson, P.C.

(57) ABSTRACT

Wind baffles are provided at a side discharge vent of a cabinet containing a heating, ventilation, air conditioning, and refrigeration (HVACR) system. The wind baffles include two or more baffles joined to a support frame. The baffles have a leading edge towards ambient environment surrounding of the cabinet and a trailing edge towards an interior of the cabinet, and the leading edge has a perimeter greater than a perimeter of the trailing edge. The baffles may surround each successive baffle. The baffles may be concentric The wind baffles may be located between ambient environment surrounding of the cabinet and a fan near the side discharge vent. The fan may be a variable-speed fan.

17 Claims, 6 Drawing Sheets

(56) References Cited

FOREIGN PATENT DOCUMENTS

| | | | | | |
|---|---|---|---|---|---|
| JP | 5582746 | B2 | | 7/2014 | |
| KR | 100939452 | B1 | * | 1/2010 | ..... F24F 13/062 |
| KR | 20160111210 | A | * | 9/2016 | ..... F24F 1/40 |
| KR | 20160113858 | A | * | 10/2016 | ..... H02P 21/00 |
| WO | WO-9833022 | A1 | * | 7/1998 | ..... F24F 13/062 |
| WO | WO-02070963 | A1 | * | 9/2002 | ..... F24F 13/062 |
| WO | WO-2004068039 | A1 | * | 8/2004 | ..... F04D 29/703 |

* cited by examiner

WIND BAFFLE FOR PREVENTING REVERSE FAN TORQUE

FIELD

This disclosure is directed to a wind baffle, more particularly a wind baffle for reducing reverse torque during cross-winds, and support frames for heating, ventilation, air conditioning, and refrigeration (HVACR) system cabinets including wind baffles.

BACKGROUND

Cross-winds can cause fans within outdoor heating, ventilation, HVACR cabinets to experience reverse torque. Fan start-up, particularly with variable-speed fans, is typically at low speeds that struggle or even fail to overcome this reverse torque. This can lead to elevated temperatures within the HVACR cabinet and poor heat transfer at the heat exchanger within the HVACR cabinet. The elevated temperatures, in turn, can lead to shut down of an HVACR system and prevent operation in ambient conditions where there are high cross-winds.

SUMMARY

This disclosure is directed to a wind baffle, more particularly a wind baffle for reducing reverse torque during cross-winds, and support frames for HVACR system cabinets including wind baffles.

A wind baffle including multiple concentric baffles provide protection from wind, allowing fans, such as variable-speed fans having low start-up power compared to their power at higher speeds, to avoid exposure to significant reverse torque. The wind baffle can be provided on a panel provided as an add-on for HVACR cabinets exposed to high cross-winds, or integrated into the HVACR cabinets themselves. Such a wind baffle can provide protection from cross-winds while providing only a small pressure drop for an exhaust fan within the HVACR cabinet, thus continuing to allow sufficient exhausting of air from a side exhaust of an HVACR cabinet without requiring additional fan power.

In an embodiment, an HVACR system includes a cabinet including a side discharge vent located on a side wall of the cabinet, a fan, located within the cabinet and at the side discharge vent, and a wind baffle located at the side discharge vent, between the fan and an ambient environment of the cabinet. The wind baffle includes a first baffle and one or more additional baffles. Each of the additional baffles surrounds one of the first baffle or one of the one or more additional baffles. Each of the plurality of concentric baffles has a leading edge at an end towards the ambient environment of the cabinet and a trailing edge at an end towards an interior of the cabinet. The leading edge has a perimeter greater than a perimeter of the trailing edge. The wind baffle also includes a support frame joining each of the plurality of the concentric baffles to the cabinet. The side wall extends vertically from a base of the cabinet to a top of the cabinet.

In an embodiment, each of the first baffle and the one or more additional baffles is straight from the leading edge of the baffle to the trailing edge of the baffle.

In an embodiment, each of the first baffle and the one or more additional baffles includes a curve between the leading edge of the baffle and the trailing edge of the baffle.

In an embodiment, the leading edge of the first baffle has a perimeter that is approximately equal to or greater than a perimeter of a trailing edge of one of the one or more additional baffles, wherein the leading edge of the one of the one or more additional baffles has a perimeter greater than the perimeter of the leading edge of the first baffle.

In an embodiment, each of the first baffle and the one or more additional baffles has a depth of at or about less than 6 inches.

In an embodiment, the one or more additional baffles includes at least two additional baffles.

In an embodiment, the first baffle includes an opening at the trailing edge.

In an embodiment, the first baffle is closed at the trailing edge.

In an embodiment, at least two of the first baffle and the one or more additional baffles have pitches that differ from one another.

In an embodiment, the fan is a variable-speed fan. In an embodiment, the variable-speed fan has a startup speed that is less than a maximum speed of the variable-speed fan and the wind baffle is configured to reduce a reverse torque applied to the variable speed fan In an embodiment, the first baffle and each of the one or more additional baffles are concentric.

In an embodiment, a method of exhausting air from an HVACR cabinet includes drawing air within the HVACR cabinet towards a side discharge vent located on a side wall of the HVACR cabinet using a variable-speed fan and directing an exhaust from the variable-speed fan through a wind baffle located at the side discharge vent. The wind baffle includes a first baffle and one or more additional baffles. Each of the one or more additional baffles surrounds one of the first baffle or one of the one or more additional baffles. Each of the first baffle and the one or more additional baffles has a leading edge at an end towards the ambient environment of the cabinet and a trailing edge at an end towards an interior of the cabinet. The leading edge has a perimeter greater than a perimeter of the trailing edge. The wind baffle also includes a support frame joining each of the first baffle and the one or more additional baffles to the cabinet. The side wall extends vertically from a base of the cabinet to a top of the cabinet.

In an embodiment, the leading edge of the first baffle has a perimeter that is approximately equal to or greater than a perimeter of a trailing edge of one of the one or more additional baffles, wherein the leading edge of the one of the one or more additional baffles has a perimeter greater than the perimeter of the leading edge of the first baffle.

In an embodiment, the one or more additional includes at least two additional baffles.

In an embodiment, the exhaust from the variable speed fan has a pressure drop of less than at or about 0.1 inches of water across the wind baffle when directing the exhaust from the variable-speed fan through the wind baffle at the side discharge vent.

In an embodiment, drawing air within the HVACR cabinet towards a side discharge vent includes reducing a susceptibility of the variable speed fan to a reverse torque applied thereto, when the variable-speed fan is operated at a startup speed that is less than a maximum speed of the variable-speed fan.

In an embodiment, the first baffle and each of the one or more additional baffles are concentric.

DRAWINGS

DETAILED DESCRIPTION

This disclosure is directed to a wind baffle, more particularly a wind baffle for reducing reverse torque during crosswinds, and support frames for heating, ventilation, air conditioning, and refrigeration (HVACR) system cabinets including wind baffles.

Fans, such as variable-speed fans, can be used to direct exhaust out of an HVACR system cabinet, for example through a side discharge vent. Fan start-up, particularly with variable-speed fans, is typically at low speeds that may lack sufficient torque to overcome the fan spinning in the reverse direction. This can lead to elevated temperatures within the HVACR cabinet, for example due to poor exhausting of air that has been heated by a condenser included within the HVACR cabinet. The elevated temperatures, in turn, can reduce function at a heat exchanger in HVACR cabinet, or even lead to shut down of an HVACR system and prevent operation in ambient conditions where there are high crosswinds.

A wind baffle can be used at or near the side discharge vent to reduce pressure applied by a cross wind entering through the side discharge vent. The wind baffle may include a plurality of baffle elements configured to deflect airflow from outside the HVACR system cabinet that is flowing towards or through the side discharge vent. The plurality of baffle elements may include, for example, baffles such as conic baffles. In an embodiment, the plurality of baffle elements are arranged to overlap when viewed in a direction perpendicular to the plane of the side discharge vent. In an embodiment, the plurality of baffle elements each have the same general shape (i.e. square, rectangular, triangular, circular) and each individual baffle element differs from the other baffle elements in size. In an embodiment, each of the plurality of baffle elements are spaced evenly from one another. In an embodiment, each of the plurality of baffle elements are concentric with one another.

Figure 1:
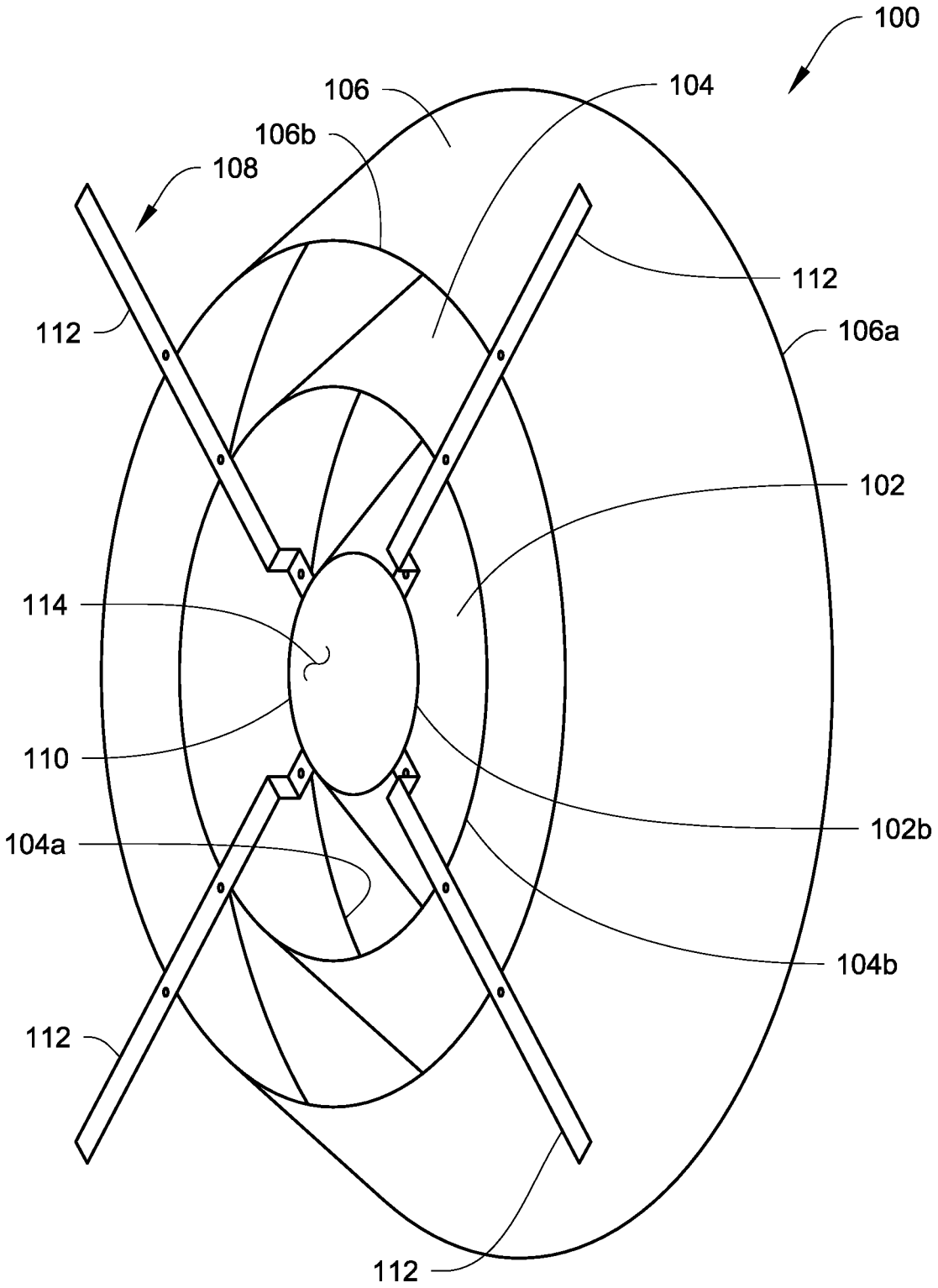
FIG. 1 shows a wind baffle according to an embodiment.

FIG. 1 shows a wind baffle 100 according to an embodiment. Wind baffle 100 includes first baffle 102, second baffle 104, and third baffle 106. Wind baffle 100 further includes support frame 108 including center panel 110 and support beams 112. Each of first baffle 102, second baffle 104, and third baffle 106 are concentric with one another. In the embodiment shown in FIG. 1, each of first baffle 102, second baffle 104, and third baffle 106 are shown as being circular.

First baffle 102 may be the innermost baffle of the plurality of baffles included in wind baffle 100. First baffle 102 includes a leading edge (not shown) and a trailing edge 102*b*. The trailing edge 102*b* is on a side of first baffle 102 towards support frame 108, and the leading edge is opposite the trailing edge 102*b*. In an embodiment, the surfaces of first baffle 102 extending from the leading edge to the trailing edge 102*b* are straight, with no curvature along the path from a point on the leading edge to the nearest point on the trailing edge 102*b*. In an embodiment, the first baffle 102 has the shape of a surface of a truncated cone. In an embodiment, the surfaces of the first baffle 102 extending from the leading edge to the trailing edge 102*b* include a concave or convex curve along the path from a point on the leading edge to the nearest point on the trailing edge 102*b*. Such curvature can be seen in FIG. 5 and is discussed below. In an embodiment, the depth of the first baffle 102, the component of the distance from the leading edge to the trailing edge 102*b* that is perpendicular to the plane of the support frame 108, is at or about less than six inches. The depth of a baffle such as first baffle 102 can be seen in FIG. 4 and is discussed below.

In an embodiment, a center portion 114 of first baffle 102 may be open at the trailing edge of the first baffle 102. In an embodiment, the center portion 114 of first baffle 102 may be closed, for example by a flat surface extending across the trailing edge of first baffle 102. In an embodiment, center portion 114 of first baffle 102 may be enclosed by the center panel 110 of support frame 108.

In an embodiment, the trailing edge of first baffle 102 may be joined to support frame 108 at center panel 110, for example by a weld, an adhesive, or a plurality of mechanical fasteners such as screws distributed along the trailing edge 102*b* of first baffle 102. In an embodiment, the trailing edge of first baffle 102 may be joined to support beams 112, for example by way of a mechanical fastener such as a screw, a weld, adhesive, or any other suitable connection securing the first baffle 102 to the support beams 112.

Second baffle 104 is a baffle, having a perimeter greater than that of the first baffle 102 at an equivalent point along its depth. Second baffle 104 is outside of first baffle 102. Second baffle 104 surrounds first baffle 102. In an embodiment, second baffle 102 radially surrounds first baffle 102. Second baffle 104 includes a leading edge (not shown) and a trailing edge 104*b*. The trailing edge is on a side of second baffle 104 towards support frame 108, and the leading edge 104*a* is opposite the trailing edge. In an embodiment, the surfaces of second baffle 104 extending from the leading edge 104*a* to the trailing edge are straight, with no curvature along the path from a point on the leading edge 104*a* to the nearest point on the trailing edge. In an embodiment, the second baffle 104 has the shape of a surface of a truncated cone. In an embodiment, the surfaces of the second baffle 104 extending from the leading edge 104*a* to the trailing edge can include a curve along the path from a point on the leading edge to the nearest point on the trailing edge. Such curvature can be seen in FIG. 5 and is discussed below. In an embodiment, the trailing edge of the second baffle 104 has a perimeter that is smaller than a perimeter of the leading edge of the first baffle 102. In an embodiment, the trailing edge of the second baffle 104 has a perimeter that is approximately equal to a perimeter of the leading edge of the first baffle 102. In an embodiment, the depth of the second baffle 104, the component of the distance from the leading edge to the trailing edge that is perpendicular to the plane of the support frame 108, is at or about less than six inches. The depth of a baffle such as first baffle 102 can be seen in FIG. 4 and is discussed below.

Third baffle 106 is a baffle, having a perimeter greater than that of the second baffle 104 at an equivalent point along its depth. Third baffle 106 is outside of second baffle 104. Third baffle 106 surrounds second baffle 104. In an embodiment, third baffle 106 radially surrounds second baffle 104. Third baffle 106 includes a leading edge 106*a* and a trailing edge 106*b*. The trailing edge 106*b* is on a side of third baffle 106 towards support frame 108, and the leading edge 106*a* is opposite the trailing edge. In an embodiment, the surfaces of third baffle 106 extending from the leading edge 106*a* to the trailing edge 106*b* are straight, with no curvature along the path from a point on the leading edge 106*a* to the nearest point on the trailing edge 106*b*. In an embodiment, the third baffle has the shape of a surface of a truncated cone. In an embodiment, the surfaces of the third baffle extending from the leading edge 106*a* to the trailing edge 106*b* can include a curve along the path from a point on the leading edge 106*a* to the nearest point on the trailing edge 106*b*. Such curvature can be seen in FIG. 5 and is discussed below. In an embodiment, the trailing edge 106*b* of the third baffle 106 has a perimeter that is smaller than a perimeter of the leading edge of the second baffle 104. In an embodiment, the trailing edge of the third baffle 106 has a perimeter that is approximately equal to a perimeter of the leading edge 104*a* of the second baffle 104. In an embodiment, the depth of the third baffle 106, the component of the distance from the leading edge to the trailing edge that is perpendicular to the plane of the support frame 108, is at or about less than six inches. The depth of a baffle such as first baffle 102 can be seen in FIG. 4 and is discussed below.

The first, second, and third baffles 102, 104, 106 may each be concentric with one another. At least one of the first, second, and third baffles 102, 104, and 106 may have a pitch angle between a line from the leading edge to the trailing edge and a line perpendicular to the plane of support frame 108 that differs from the pitch angles of at least one of the other baffles. In an embodiment, the pitch angles of each of the first, second, and third baffles 102, 104, 106 are all the same as one another. Pitch angles and their relationships to one another can be seen in FIG. 4 and are further detailed below.

Support frame 108 includes a center panel 110 and a plurality of support beams 112 extending from the center panel 110. In an embodiment, the support beams 112 are evenly radially distributed around center panel 110, such that the angle between any two adjacent support beams 112 is the same as the angle between any other two adjacent support beams 112. For example, the angle between each of support beams 112 may be at or about 180° in an embodiment including two support beams 112, at or about 120° in an embodiment including three support beams 112, at or about 90° in an embodiment including four support beams 112 as shown in FIG. 1, and so on. Each of the support beams 112 can be connected to at least the second baffle 104 and the third baffle 106, and any additional baffles beyond the third baffle 106 at the trailing edges of those respective baffles. The connection of the support beams 112 to the baffles may be by way of a mechanical fastener such as a screw, a weld, adhesive, or any other suitable connection securing the baffles 104, 106 to the support beam 112.

In an embodiment, wind baffle 100 may include two or more baffles joined to support frame 108. In an embodiment of wind baffle 100, the first baffle 102 and the second baffle 104 may be included and the third baffle 106 excluded. In an embodiment where wind baffle 100 includes more than three baffles, additional baffles can be provided outside of the third baffle 106. In this embodiment, the additional baffles beyond third baffle in 106 are each larger in perimeter at a leading edge than the preceding baffle at its leading edge. In this embodiment, the additional baffles are also concentric with all of the other baffles of the wind baffle 100, including first baffle 102.

Each of first, second, and third baffles 102, 104, 106, and the support frame 108 may include one or more metals or alloys, for example, aluminum or steel. Each of first, second, and third baffles 102, 104, 106, and the support frame 108 may include one or more plastics. In an embodiment, all of first, second, and third baffles 102, 104, 106, and the support frame 108 are made of the same material. In an embodiment, at least one of first, second, and third baffles 102, 104, 106, and the support frame 108 includes materials different from the other components of wind baffle 100.

Figure 2:
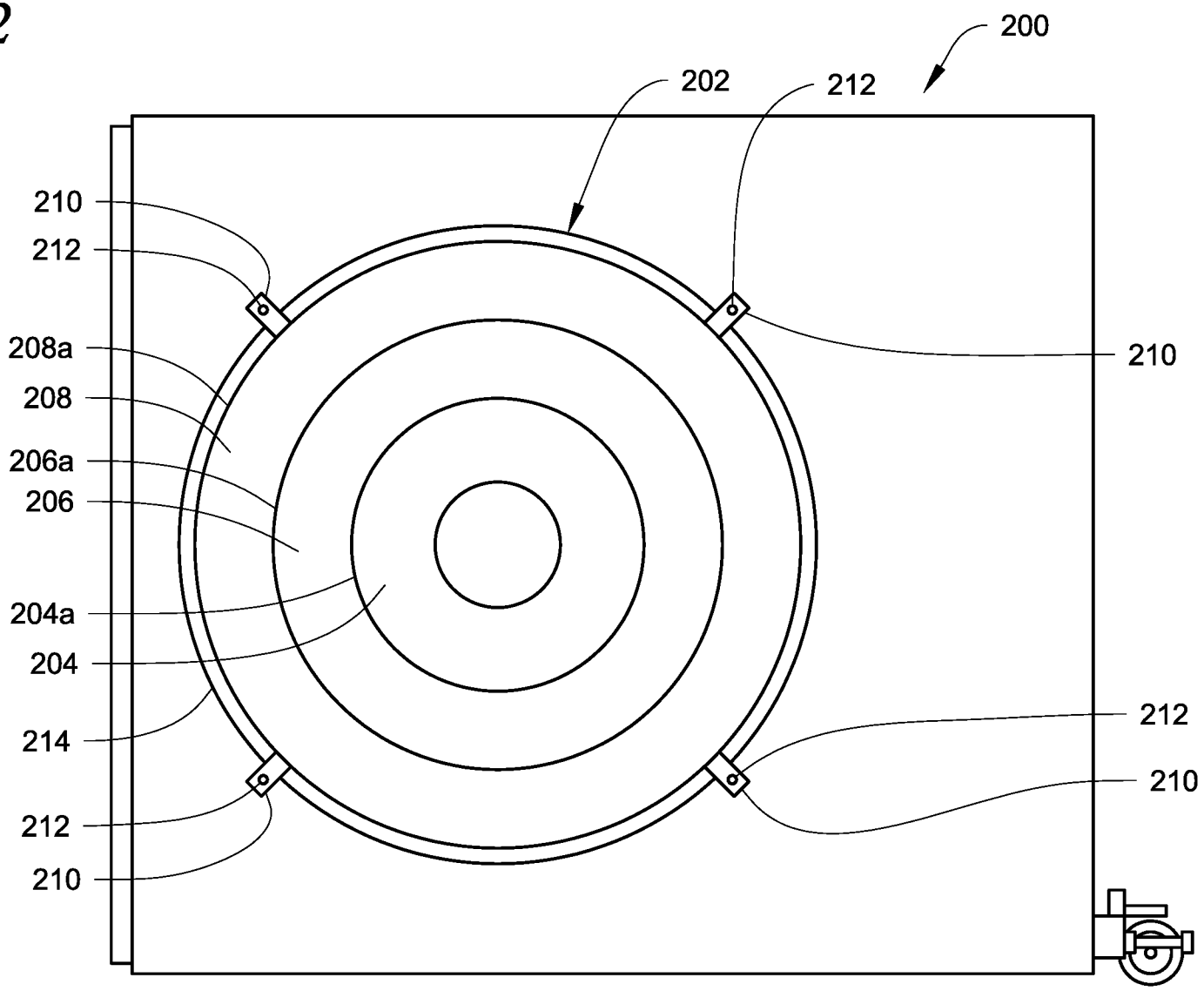
FIG. 2 shows a wind baffle mounted on a heating, ventilation, air conditioning and refrigeration (HVACR) system cabinet according to an embodiment.

FIG. 2 shows a wind baffle 202 mounted on an HVACR system cabinet 200 according to an embodiment.

HVACR system cabinet 200 may be a cabinet surrounding one or more components of an HVACR system, such as a residential heat pump, air conditioner, refrigerator, ventilation system, or the like. In an embodiment, HVACR system cabinet 200 is an outdoor cabinet for an air conditioner system. In an embodiment, HVACR system cabinet 200 contains at least one of a compressor and an evaporator (not shown).

Wind baffle 202 may be, for example, the wind baffle 100 described above. Wind baffle 202 includes a first baffle 204, a second baffle 206, a third baffle 208, and support beams 210 of a support frame, the ends of which are visible in the view shown in FIG. 2. First baffle 204 may be or include the features of first baffle 102 of wind baffle 100 described above. Second baffle 206 may be or include the features of second baffle 104 of wind baffle 100 described above. Third baffle 208 may be or include the features of third baffle 106 of wind baffle 100 described above.

In FIG. 2, a leading edge 204*a* of first baffle 204 has a perimeter equal to or larger than the perimeter of the trailing edge of the second baffle 206. The leading edge 206*a* of the second baffle 206 has a perimeter that is equal to or larger than the trailing edge of the third baffle 208. The leading edge 208*a* of the third baffle 208 has a perimeter that is equal to or larger than the perimeter of the side discharge vent 214 included in HVACR system cabinet 200. From the perspective provided in the view of FIG. 2, the side discharge vent 214 and the fan (not shown) associated with the side discharge vent 214*a* re obscured by the baffles 204, 206, and 208 of wind baffle 202. The entire side discharge vent 214 may be covered by the wind baffle 202 when viewed straight on, as in the view shown in FIG. 2.

Support beams 210 are part of a support frame (not shown), obscured by the first, second, and third baffles 204, 206, 208 in the view shown in FIG. 2. In an embodiment, support beams 210 may be joined to at least the second and third baffles 206, 208, and may further be joined to the first baffle 204. In an embodiment, support beams 210 may be joined to the baffles by way of a mechanical fastener such as a screw, a weld, adhesive, or any other suitable connection.

The ends of support beams 210 may be fixed to an exterior of the HVACR system cabinet 200, for example at connection points 212 distributed on the HVACR system cabinet 200 surrounding the side discharge vent. Connections between the support beams 210 and the HVACR system cabinet 200 may be any suitable mechanical connection to secure the wind baffle 202 in place relative to HVACR system cabinet 200, for example, welds, or screws or other mechanical fasteners.

Figure 3:
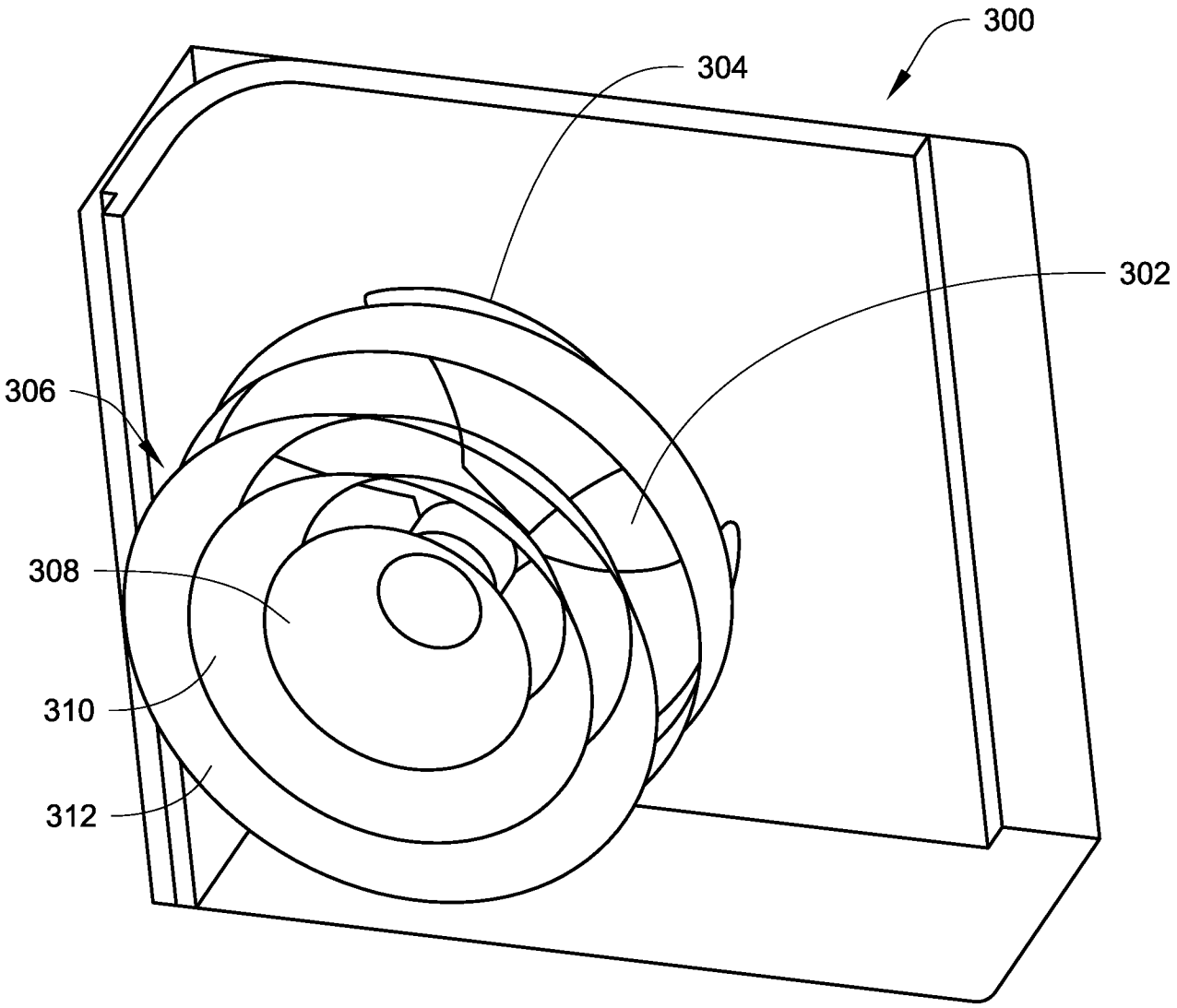
FIG. 3 shows an HVACR system cabinet including a wind baffle according to an embodiment.

FIG. 3 shows an HVACR system cabinet 300 including a wind baffle 306 according to an embodiment. HVACR system cabinet 300 includes a side discharge vent 302 and a fan 304. Wind baffle 306 is fixed to HVACR system cabinet 300 in a position corresponding to the side discharge vent 302.

Side discharge vent 302 is an opening in a side wall of HVACR system cabinet 300 allowing airflow to be directed out of the HVACR system cabinet 300. The side discharge vent 302 permits exhaust of air out of the HVACR system cabinet 300. The side discharge vent 302 permits the exhaust to leave the HVACR system cabinet 300 on a side of the HVACR system cabinet. For example, air heated by heat exchange with a condenser located within the HVACR system cabinet 300 can be discharged through the side discharge vent 302. The condenser can be an outdoor heat exchanger included in a refrigeration circuit. In an embodiment, a plane of the side discharge vent 302 is substantially vertical. In an embodiment, side discharge vent 302 is circular in shape. In an embodiment, the side discharge vent can be another shape, for example, square. In an embodiment, side discharge vent 302 is located centrally on a side wall of HVACR system cabinet 300. Side discharge vent 302 may include a mount for fan 304. Side discharge vent 302 is disposed on a side wall of the HVACR system cabinet. The side wall of the HVACR system cabinet 300 extends vertically from a base of the HVACR system cabinet 300 to a top of the HVACR system cabinet 300.

Fan 304 is a fan located within the HVACR system cabinet 300. Fan 304 may be located in the path of airflow through the side discharge vent 302. Fan 304 may be configured to direct air out of HVACR system cabinet 300 by way of side discharge vent 302. In an embodiment, the blades of fan 304 are oriented to drive air outwards with respect to HVACR system cabinet 300 when rotating in their normal direction. Airflow entering the HVACR system cabinet 300 through side discharge vent 302, such as a crosswind, may apply force to the blades of fan 304, producing a torque opposite the direction of rotation of fan 304. Fan 304 may be powered by an electric motor. Fan 304 may be a variable-speed fan. In an embodiment, fan 304 is controlled by a variable speed drive. In an embodiment, starting operations of fan 304 occur at speeds below the maximum speed of fan 304.

Wind baffle 306 is a wind baffle joined to the HVACR system cabinet 300, for example, wind baffle 100 described above and shown in FIG. 1. Wind baffle 306 includes a first baffle 308, a second baffle 310, and a third baffle 312. First baffle 308 may be or include the features of first baffle 102 of wind baffle 100 described above. Second baffle 310 may be or include the features of second baffle 104 of wind baffle 100 described above. Third baffle 312 may be or include the features of third baffle 106 of wind baffle 100 described above.

The wind baffle 306 may further include a support frame, such as the support frame 108 described above for wind baffle 100, including center panel 110 and support beams 112. The support frame may be provided on a trailing edge side of the wind baffle 306. The support beams of the support frame may extend past a perimeter of the side discharge vent 302 when the center of the support frame is centered within the side discharge vent 302. The portion of each support beam extending past the side discharge vent 302 may include a connection point to the HVACR system cabinet 300. Connections between the support beams and the HVACR system cabinet 300 may be any suitable mechanical connection to secure the wind baffle 306 in place relative to the side discharge vent 302. Connections at those connection points may include, for example, adhesives, welds, screws or other mechanical fasteners or any other suitable connection of the wind baffle 306 to the HVACR system cabinet 300.

Figure 4:
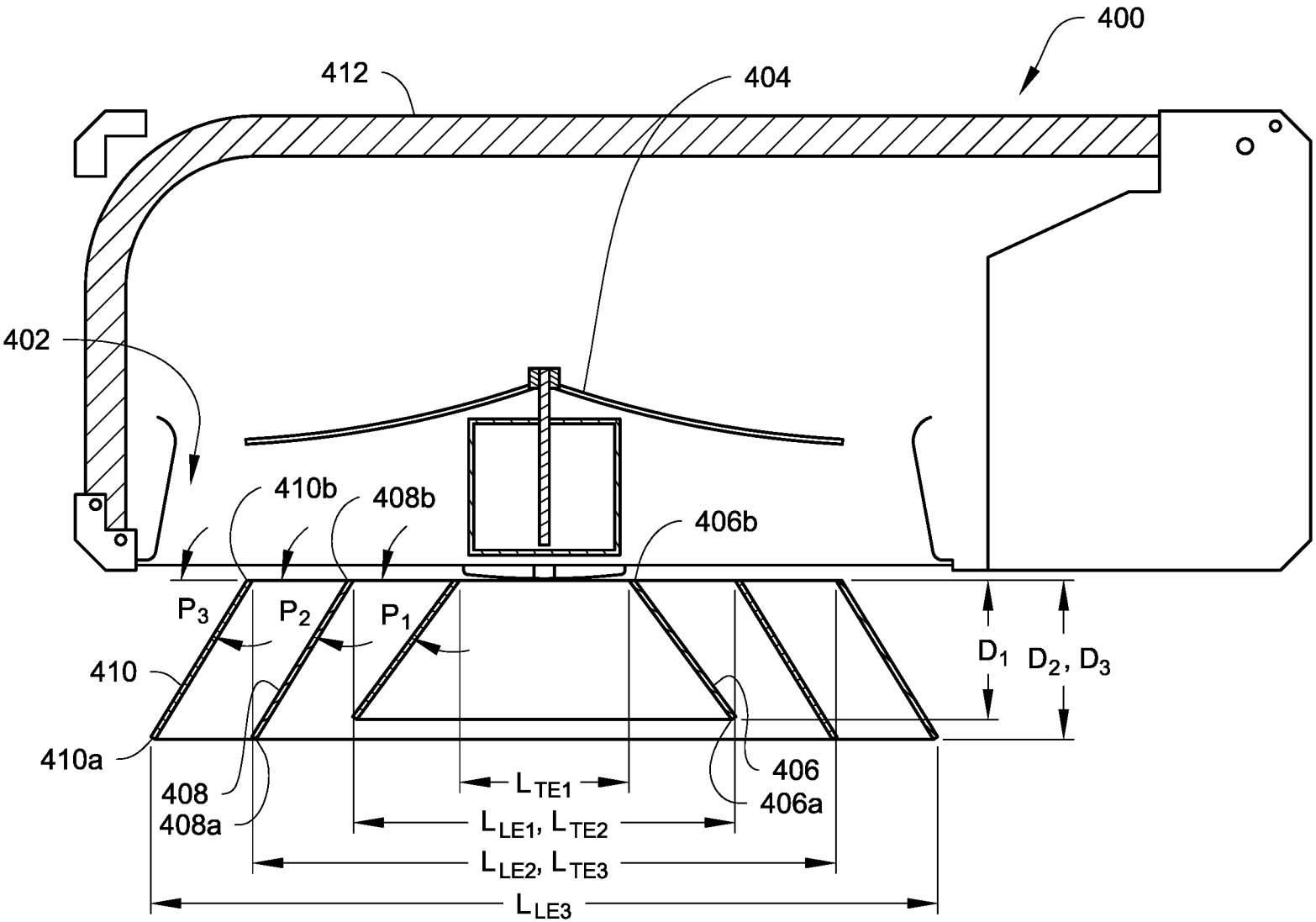
FIG. 4 shows a sectional view of an HVACR system cabinet including a wind baffle according to an embodiment.

FIG. 4 shows a sectional view of an HVACR system cabinet 400 including a wind baffle according to an embodiment. HVACR cabinet 400 includes a side discharge vent 402 and a fan 404 including a motor. In an embodiment, concentric baffles 406, 408, 410 are provided in the side discharge vent 402.

HVACR cabinet 400 is a cabinet containing part of an HVACR system, for example an outdoor unit of a refrigeration circuit. The HVACR cabinet 400 can contain a condenser which rejects heat to air within the HVACR cabinet 400. HVACR cabinet 400 includes heat exchanger 412.

Side discharge vent 402 is an opening in a side wall of HVACR system cabinet 400. Side discharge vent 402 allows airflow to be directed out of the HVACR system cabinet 400. The side discharge vent 402 permits exhaust of air out of the HVACR system cabinet 400. For example, air heated by heat exchange with a condenser located within the HVACR system cabinet 400 can be discharged through the side discharge vent 402. The condenser can be an outdoor heat exchanger included in a refrigeration circuit. In an embodiment, a plane of the side discharge vent 402 is substantially vertical. In an embodiment, side discharge vent 402 is circular in shape. In an embodiment, the side discharge vent can have another shape, for example square. In an embodiment, side discharge vent 402 is located centrally on a side wall of HVACR system cabinet 400. Side discharge vent 402 may include a mount for fan 404. Side discharge vent can be, for example, circular or square in shape.

Fan 404 is a fan configured to draw air within HVACR system cabinet 400 and exhaust air towards the side discharge vent 402. Fan 404 can be a variable-speed fan. Fan 404 can be powered by an electric motor. In an embodiment, the blades of fan 404 are oriented to drive air outwards with respect to HVACR system cabinet 400 when rotating in their normal direction. Airflow entering the HVACR system cabinet 400 through side discharge vent 402, such as a crosswind, may apply force to the blades of fan 404, producing a torque opposite the direction of rotation of fan 404. In an embodiment, fan 404 is controlled by a variable speed drive. In an embodiment, starting operations of fan 404 occur at speeds below the maximum speed of fan 404. Fan 404 can draw air through heat exchanger 412 as it exhausts air through side discharge vent 402.

First concentric baffle 406 has a leading edge 406*a* and a trailing edge 406*b*. Leading edge 406*a* is located at the end of the first concentric baffle 406 that is towards the ambient environment surrounding HVACR system cabinet 400. Leading edge 406*a* has a width $L_{LE1}$. Trailing edge 406*b* is located at the end of first concentric baffle 406 that is towards fan 404. Trailing edge 406*b* has a width $L_{TE1}$. Trailing edge 406*b* has a perimeter that is smaller than the perimeter of leading edge 406*a*. The distance from leading edge 406*a* to trailing edge 406*b* in a direction perpendicular to the side wall of HVACR cabinet 400 including side discharge vent 402 is the depth $D_1$. An angle between first concentric baffle 406 and the plane of the side wall of HVACR system cabinet 400 including the side discharge vent 402 is the pitch $P_1$.

Second concentric baffle 408 surrounds first concentric baffle 406. Second concentric baffle 408 is concentric with first concentric baffle 406. Second concentric baffle 408 has a leading edge 408*a* and a trailing edge 408*b*. Leading edge 408*a* is located at the end of the second concentric baffle 408 that is towards the ambient environment surrounding HVACR system cabinet 400. Leading edge 408*a* has a width $L_{LE2}$. Trailing edge 408*b* is located at the end of second concentric baffle 408 that is towards fan 404. Trailing edge 408*b* has a width $L_{TE2}$. Trailing edge 408*b* has a perimeter that is smaller than the perimeter of leading edge 408*a*. The distance from leading edge 408*a* to trailing edge 408*b* in a direction perpendicular to the side wall of HVACR cabinet 400 including side discharge vent 402 is the depth $D_2$. An angle between second concentric baffle 408 and the plane of the side wall of HVACR system cabinet 400 including the side discharge vent 402 is the pitch $P_2$.

Third concentric baffle 410 surrounds first concentric baffle 406 and second concentric baffle 408. Third concentric baffle 410 is concentric with first concentric baffle 406 and second concentric baffle 408. Third concentric baffle 410 has a leading edge 410*a* and a trailing edge 410*b*. Leading edge 410*a* is located at the end of the third concentric baffle 410 that is towards the ambient environment surrounding HVACR system cabinet 400. Leading edge 410*a* has a width $L_{LE3}$. Trailing edge 410*b* is located at the end of third concentric baffle 410 that is towards fan 404. Trailing edge 410*b* has a width $L_{TE3}$. Trailing edge 410*b* has a perimeter that is smaller than the perimeter of leading edge 410*a*. The distance from leading edge 410*a* to trailing edge 410*b* in a direction perpendicular to the side wall of HVACR cabinet 400 including side discharge vent 403 is the depth $D_3$. An angle between third concentric baffle 410 and the plane of the side wall of HVACR system cabinet 400 including the side discharge vent 402 is the pitch $P_3$.

The widths of the leading edges 406*a*, 408*a*, and 410*a* and the trailing edges 406*b*, 408*b*, and 410*b* can be selected such that $L_{LE1} \geq L_{TE2}$ and $L_{LE2} \geq L_{TE3}$. In an embodiment where side discharge vent 402 is circular in shape, each of the widths is a diameter. The widths of the 406*a*, 408*a*, and 410*a* and the trailing edges 406*b*, 408*b*, and 410*b* can be such that the perimeter of first concentric baffle leading edge 406*a* is greater than or substantially equal to the perimeter of second concentric baffle trailing edge 408*b*, and the perimeter of second concentric baffle leading edge 408*a* is greater than or substantially equal to the perimeter of third concentric baffle trailing edge 410*b*.

In an embodiment, each of the concentric baffles 406, 408, 410 can have depths that are substantially equal to one another. In an embodiment, at least some of the depths may vary among the first, second, and third concentric baffles 406, 408, 410. In an embodiment $D_1 < D_2 \approx D_3$, as shown in FIG. 4. In an embodiment, the depth of each of the concentric baffles is at or about less than six inches.

In an embodiment, each of the concentric baffles 406, 408, 410 have pitch angles substantially equal to one another. In an embodiment, at least some of the pitch angles vary among the first, second, and third concentric baffles 406, 408, 410. In an embodiment, $P_1 < P_2 \approx P_3$, as shown in FIG. 4.

Heat exchanger 412 can form a portion of the wall of HVACR cabinet 400. Heat exchanger 412 is a heat exchanger that allows air to flow into HVACR cabinet 400. In heat exchanger 412, a refrigerant exchanger heat with the air flowing through heat exchanger 412 into the HVACR cabinet 400. In an embodiment, heat exchanger 412 forms part of a wall of HVACR cabinet 400 that is opposite the wall including side discharge vent 402. Heat exchanger 412 can be, for example a tube-and-fin heat exchanger. Air that has exchanged heat at heat exchanger 412 can be the air that is exhausted through side discharge vent 402.

Figure 5:
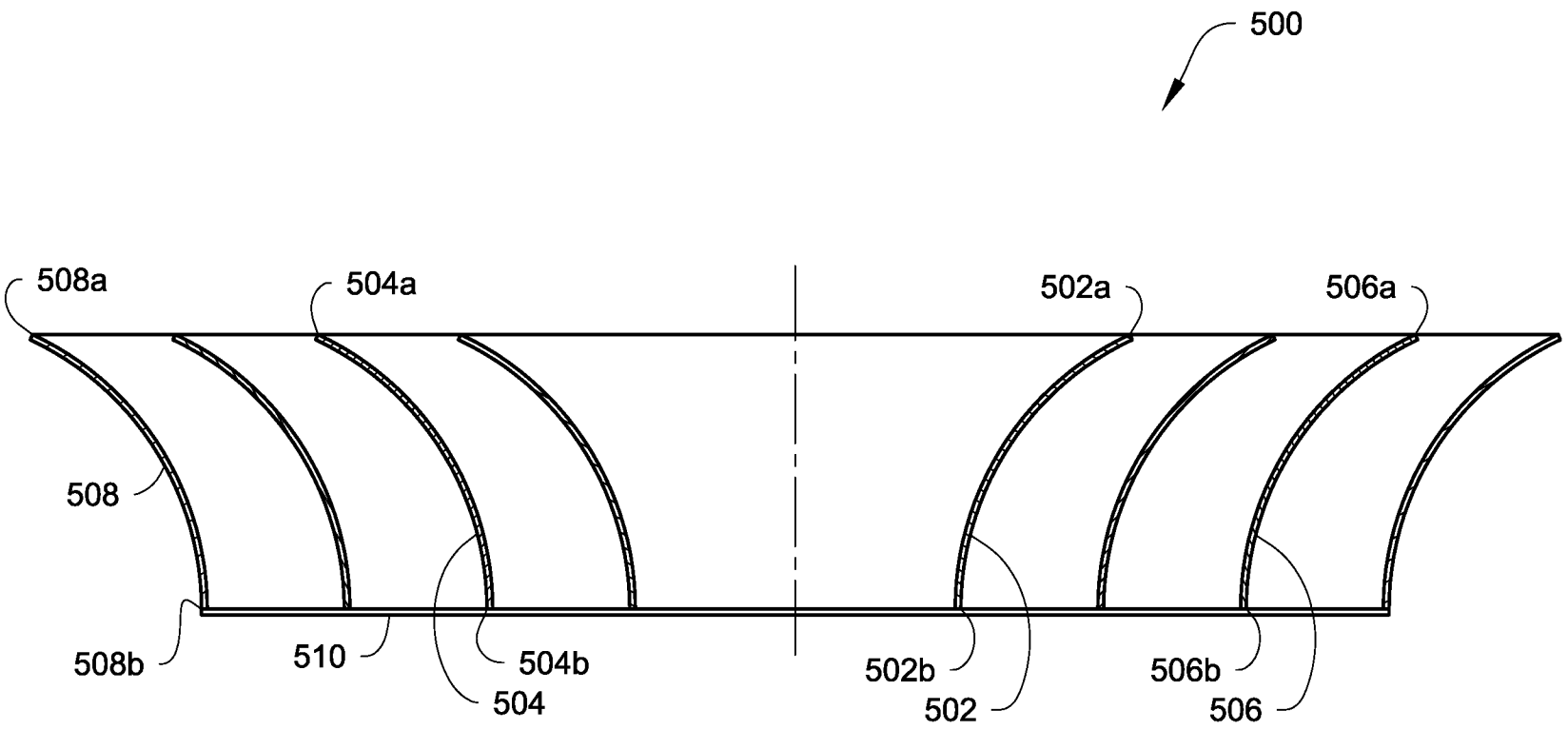
FIG. 5 shows a sectional view of a wind baffle according to an embodiment.

FIG. 5 shows a sectional view of a wind baffle 500 according to an embodiment. Wind baffle 500 includes first baffle 502, second baffle 504, third baffle 506, and fourth baffle 508. Each of first, second, third, and fourth baffles 502, 504, 506, and 508 are joined to support frame 510. Each of first, second, third, and fourth baffles 502, 504, 506, and 508 are curved from their respective leading edges 502*a*, 504*a*, 506*a*, and 508*a* to their respective trailing edges 502*b*, 504*b*, 506*b*, and 508*b*, such that they each have a convex shape.

Figure 6A:
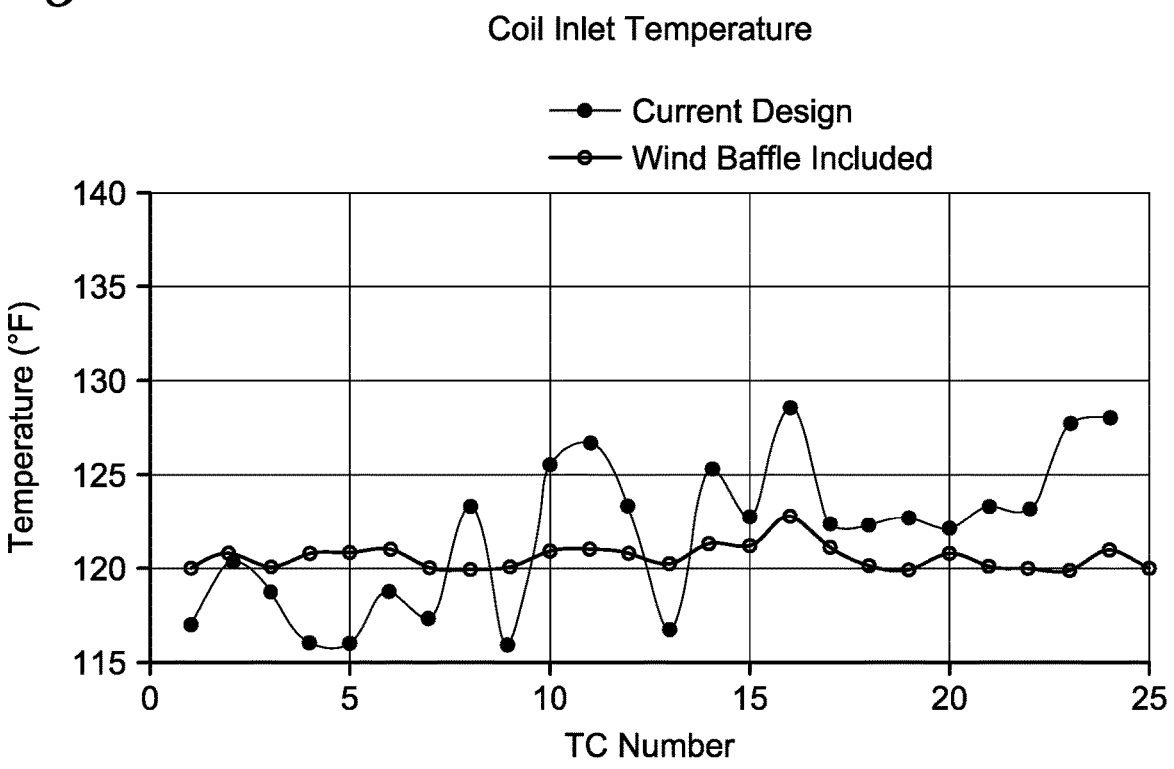
FIGS. 6A and 6B show temperature data within an HVACR cabinet when operated under a crosswind according to an embodiment.
Figure 6B:
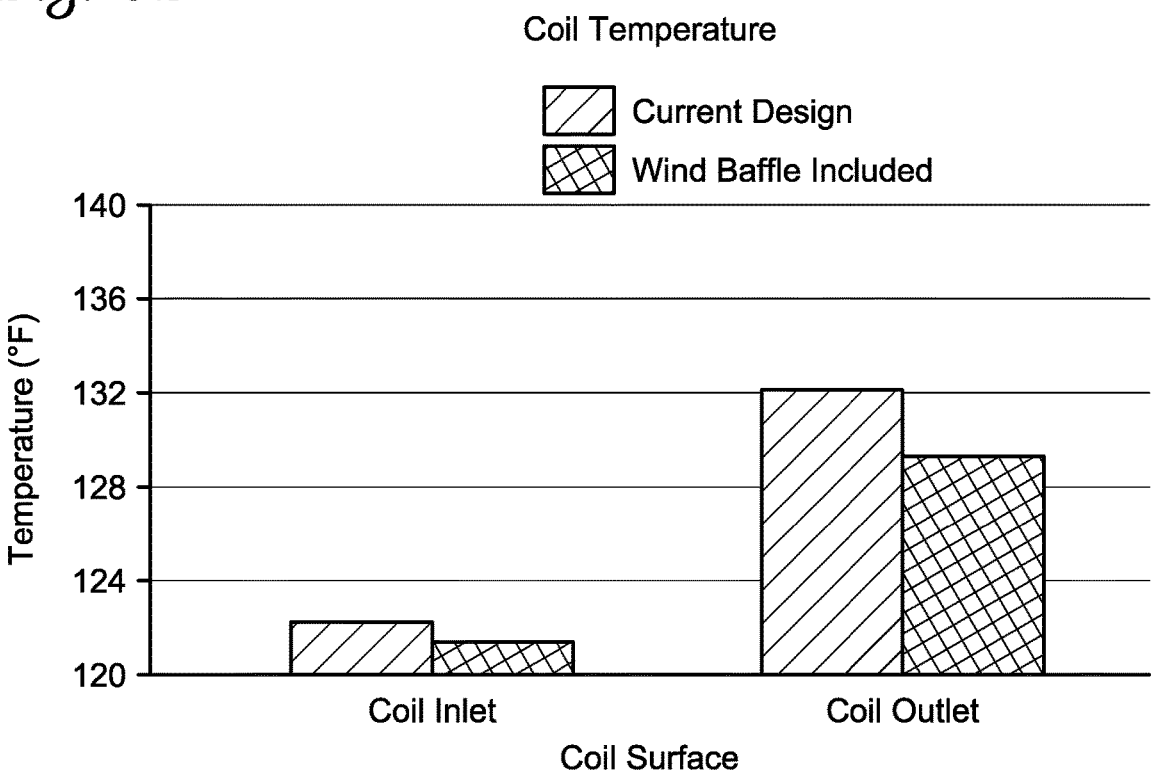

FIGS. 6A and 6B show modeled temperature data within an HVACR cabinet when operated under a crosswind according to an embodiment. Modeling is used to determine air temperatures within an HVACR cabinet using a current side discharge vent design, at a dry bulb ambient temperature of 115° F., and in an HVACR cabinet including a wind baffle according to an embodiment, at a dry bulb ambient temperature of 120° F. For the modeling results shown in FIGS. 6A and 6B, the crosswind is modeled as being 29 miles per hour. Each of the TC numbers included in FIG. 6A represents a particular position within the HVACR cabinet at which a modeled temperature is obtained. The chart in FIG. 6A shows the modeled temperature at each of those positions indicated by their respective TC numbers, each TC number corresponding to a particular point within the cabinet where the temperature is modeled. FIG. 6B shows the inlet and outlet temperatures from the model. The inlet temperature is tested, at least in part, to evaluate whether poor exhausting leads to recirculation of air into the HVACR cabinet.

FIG. 6A shows temperature data for a number of points near the side exhaust vent of an HVACR system cabinet for both a current design and for when a wind baffle is included at the side exhaust vent. The temperature data shows a more even temperature distribution under these conditions when the wind baffle is included in the design, as can be seen in FIG. 6A. Further, the variance is significantly reduced between individual points for the test including the wind baffle, compared to existing designs. Thus, the temperature results are indicative of improved flow through the HVACR cabinet based on the improved exhaust performance. This results in fewer hot spots and a lower average temperature in the HVACR cabinet. The improved exhausting from the HVACR cabinet improves the function of the outdoor HVACR unit housed within and reducing the risk of shutdown due to excessive temperatures when under cross-wind conditions and even at high ambient temperatures.

FIG. 6B shows the temperature at the inlet and outlet of a coil within the HVACR cabinet for both a previous design, and including the wind baffle described herein. The HVACR cabinet can contain an outdoor unit of an HVACR system. The coil can be a condenser of the outdoor unit of a refrigeration or air conditioning system. As can be seen in FIG. 6B, coil temperatures for the coil within the HVACR cabinet are lower at both the inlet and outlet of the coil for the HVACR cabinet including a wind baffle according to an embodiment. This indicates that the wind baffle improves airflow through the coil. Further, the reduced inlet temperature indicates that less recirculation of heated air from the HVACR cabinet to the coil occurs in the HVACR cabinet including a wind baffle according to an embodiment. The reduced inlet and outlet temperatures for the coil demonstrate improved airflow through and out of the HVACR cabinet, and reduce the chances of shutdown due to coil overheating when a wind baffle is included according to an embodiment.

Further, pressure drop across wind baffles according to embodiments was also modeled at an ambient dry bulb temperature of 120 F and a wet bulb temperature of 80 F, while operating a standard fan for the HVACR cabinet at 1000 revolutions per minute. Modeled under these conditions, the pressure drop being less than at or about 0.1 inches of water. In an embodiment, the modeled pressure drop was at or about 0.02 inches of water. The low pressure drop across wind baffles according to embodiments indicates that wind baffles according to embodiments do not provide undue to excessive resistance to exhaust from the HVACR cabinet.

Aspects:

It is understood that any of aspects 1-12 can be combined with any of aspects 13-18.

Aspect 1. A heating, ventilation, air conditioning and refrigeration (HVACR) system, comprising:

a cabinet including a side discharge vent located on a side wall of the cabinet, wherein the side wall extends vertically from a cabinet base to a cabinet top;

a fan, located within the cabinet and at the side discharge vent;

a wind baffle located at the side discharge vent, between the fan and an ambient environment of the cabinet, wherein the wind baffle includes:

a first baffle;

one or more additional baffles, wherein each of the one or more additional baffles surrounds the first baffle or one of the one or more additional baffles, and wherein each of the first baffle and the one or more additional baffles has a leading edge at an end towards the ambient environment of the cabinet and a trailing edge at an end towards an interior of the cabinet, and the leading edge has a perimeter greater than a perimeter of the trailing edge; and a support frame, fixed to an exterior of the cabinet, the support frame joining each of the first baffle and the one or more additional baffles to the cabinet.

Aspect 2. The HVACR system according to aspect 1, wherein each of the first baffle and the one or more additional baffles is straight from the leading edge of the baffle to the trailing edge of the baffle.

Aspect 3. The HVACR system according to aspect 1, wherein each of the first baffle and the one or more additional includes a curve between the leading edge of the baffle and the trailing edge of the baffle.

Aspect 4. The HVACR system according to any of aspects 1-3, wherein the leading edge of the first baffle has a perimeter that is approximately equal to or greater than a perimeter of a trailing edge of one of the one or more additional baffles, wherein the leading edge of the one of the one or more additional baffles has a perimeter greater than the perimeter of the leading edge of the first baffle.

Aspect 5. The HVACR system according to any of aspects 1-4, wherein each of the first baffle and the one or more additional baffles has a depth of at or about less than 6 inches.

Aspect 6. The HVACR system according to any of aspects 1-5, wherein the one or more additional baffles includes at least two additional baffles.

Aspect 7. The HVACR system according to any of aspects 1-6, wherein the first baffle includes an opening at the trailing edge.

Aspect 8. The HVACR system according to any of aspects 1-6, wherein the first baffle of the plurality of concentric baffles is closed at the trailing edge.

Aspect 9. The HVACR system according to any of aspects 1-8, wherein at least two of the first baffle and the one or more additional baffles have pitch angles that differ from one another.

Aspect 10. The HVACR system according to any of aspects 1-9, wherein the fan is a variable-speed fan.

Aspect 11. The HVACR system according to aspect 10, wherein the wind baffle is configured to reduce a susceptibility of the variable speed fan to a reverse torque applied thereto, when the variable-speed fan has a startup speed that is less than a maximum speed of the variable-speed fan.

Aspect 12. The HVACR system according to any of aspects 1-11, wherein the first baffle and each of the one or more additional baffles are concentric.

Aspect 13. A method of exhausting air from an HVACR cabinet, comprising:

drawing air within the HVACR cabinet towards a side discharge vent located on a side wall of the HVACR cabinet using a variable-speed fan; and directing an exhaust from the variable-speed fan through a wind baffle located at the side discharge vent, wherein the wind baffle includes:

a first baffle;

one or more additional baffles, wherein each of the one or more additional baffles surrounds one of the first baffle or one of the one or more additional baffles, wherein each of the first baffle and the one or more additional baffles has a leading edge at an end towards an ambient environment of the cabinet and a trailing edge at an end towards an interior of the cabinet, and the leading edge has a perimeter greater than a perimeter of the trailing edge; and a support frame joining each of the first baffle and the one or more additional baffles to the cabinet, and the side wall extends vertically from a cabinet base to a cabinet top.

Aspect 14. The method according to aspect 13, wherein the leading edge of the first has a perimeter that is approximately equal to or greater than a perimeter of one of the one or more additional baffles, wherein the leading edge of the one of the one or more additional baffles has a perimeter greater than the perimeter of the leading edge of the first baffle.

Aspect 15. The method according to any of aspects 13-14, wherein the one or more additional baffles includes at least two additional baffles.

Aspect 16. The method according to any of aspects 13-15, wherein the exhaust from the variable speed fan has a pressure drop of less than at or about 0.1 inches of water across the wind baffle when directing the exhaust from the variable-speed fan through the wind baffle at the side discharge vent.

Aspect 17. The method according to any of aspects 13-16, wherein drawing air within the HVACR cabinet towards a side discharge vent includes reducing a susceptibility of the variable speed fan to a reverse torque applied thereto, when the variable-speed fan is operated at a startup speed that is less than a maximum speed of the variable-speed fan Aspect 18. The method according to any of aspects 13-17, wherein the first baffle and each of the one or more additional baffles are concentric.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heating, ventilation, air conditioning and refrigeration (HVACR) system, comprising:

a cabinet including a side discharge vent located on a side wall of the cabinet, wherein the side wall extends vertically from a cabinet base to a cabinet top;

a fan, located within the cabinet and at the side discharge vent;

a wind baffle located at the side discharge vent, between the fan and an ambient environment of the cabinet, wherein the wind baffle includes:

a first baffle;

two or more additional baffles, wherein each of the two or more additional baffles surrounds the first baffle or one of the two or more additional baffles, and wherein each of the first baffle and the two or more additional baffles has a leading edge at an end towards the ambient environment of the cabinet and a trailing edge at an end towards an interior of the cabinet, and the leading edge has a perimeter greater than a perimeter of the trailing edge; and a support frame, fixed to an exterior of the cabinet, the support frame joining each of the first baffle and the two or more additional baffles to the cabinet;

wherein the wind baffle is configured to reduce pressure applied by an outdoor cross wind entering through the side discharge vent, the first baffle has a first pitch angle, each of the two or more additional baffles has a second pitch angle, and the first pitch angle is smaller than the second pitch angle.

2. The HVACR system of claim 1, wherein each of the first baffle and the two or more additional baffles is straight from the leading edge of the baffle to the trailing edge of the baffle.

3. The HVACR system of claim 1, wherein each of the first baffle and the two or more additional baffles includes a curve between the leading edge of the baffle and the trailing edge of the baffle.

4. The HVACR system of claim 1, wherein the leading edge of the first baffle has a perimeter that is approximately equal to or greater than a perimeter of a trailing edge of one of the two or more additional baffles, wherein the leading edge of the one of the two or more additional baffles has a perimeter greater than the perimeter of the leading edge of the first baffle.

5. The HVACR system of claim 1, wherein each of the first baffle and the two or more additional baffles has a depth of at or about less than 6 inches.

6. The HVACR system of claim 1, wherein the first baffle includes an opening at the trailing edge.

7. The HVACR system of claim 1, wherein the first baffle is closed at the trailing edge.

8. The HVACR system of claim 1, wherein the fan is a variable-speed fan.

9. The HVACR system of claim 8, wherein the wind baffle is configured to reduce a susceptibility of the variable speed fan to a reverse torque applied thereto, when the variable-speed fan has a startup speed that is less than a maximum speed of the variable-speed fan.

10. The HVACR system of claim 1, wherein the first baffle and each of the two or more additional baffles are concentric.

11. A method of exhausting air from an HVACR cabinet, comprising:

drawing air within the HVACR cabinet towards a side discharge vent located on a side wall of the HVACR cabinet using a variable-speed fan; and directing an exhaust from the variable-speed fan through a wind baffle located at the side discharge vent, wherein the wind baffle includes:

a first baffle;

two or more additional baffles, wherein each of the two or more additional baffles surrounds one of the first baffle or one of the two or more additional baffles, wherein each of the first baffle and the two or more additional baffles has a leading edge at an end towards an ambient environment of the cabinet and a trailing edge at an end towards an interior of the cabinet, and the leading edge has a perimeter greater than a perimeter of the trailing edge; and a support frame joining each of the first baffle and the two or more additional baffles to the cabinet, and the side wall extends vertically from a cabinet base to a cabinet top, wherein the first baffle has a first pitch angle, each of the two or more additional baffles has a second pitch angle, and the first pitch angle is smaller than the second pitch angle.

12. The method of claim 11, wherein the leading edge of the first baffle has a perimeter that is approximately equal to or greater than a perimeter of a trailing edge of one of the two or more additional baffles, wherein the leading edge of the one of the two or more additional baffles has a perimeter greater than the perimeter of the leading edge of the first baffle.

13. The method of claim 11, wherein the exhaust from the variable speed fan has a pressure drop of less than at or about 0.1 inches of water across the wind baffle when directing the exhaust from the variable-speed fan through the wind baffle at the side discharge vent.

14. The method of claim 11, wherein drawing air within the HVACR cabinet towards a side discharge vent includes reducing a susceptibility of the variable speed fan to a reverse torque applied thereto, when the variable-speed fan is operated at a startup speed that is less than a maximum speed of the variable-speed fan.

15. The method of claim 11, wherein the first baffle and each of the two or more additional baffles are concentric.

16. A method of reducing pressure applied by an outdoor cross wind entering from the outdoors through a side discharge vent of a heating, ventilation, air conditioning, and refrigeration (HVACR) system, comprising:

positioning a wind baffle over the side discharge vent, the side discharge vent provided on a cabinet containing an outdoor unit of the HVACR system, and deflecting at least a portion of the outdoor cross wind using the wind baffle, wherein the wind baffle includes:

a first baffle;

two or more additional baffles, wherein each of the two or more additional baffles surrounds one of the first baffle or one of the two or more additional baffles, wherein each of the first baffle and the two or more additional baffles has a leading edge at an end towards an outdoor ambient environment of the cabinet and a trailing edge at an end towards an interior of the cabinet, and the leading edge has a perimeter greater than a perimeter of the trailing edge, the first baffle has a first pitch angle, each of the two or more additional baffles has a second pitch angle, and the first pitch angle is smaller than the second pitch angle.

17. The method of claim 16, further comprising starting a fan of the outdoor unit of the HVACR system, wherein the fan has a torque when started that is less than a torque when the fan is at a maximum speed of the fan, and wherein the pressure applied by the outdoor cross wind is reduced to below the torque when started of the fan.

* * * * *